US008899064B2

(12) United States Patent
Hwang

(10) Patent No.: US 8,899,064 B2
(45) Date of Patent: Dec. 2, 2014

(54) REFRIGERATOR

(75) Inventor: Gue-Sec Hwang, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 1072 days.

(21) Appl. No.: 12/747,569

(22) PCT Filed: Dec. 11, 2008

(86) PCT No.: PCT/KR2008/007337

§ 371 (c)(1),
(2), (4) Date: Jun. 11, 2010

(87) PCT Pub. No.: WO2009/078620

PCT Pub. Date: Jun. 25, 2009

(65) Prior Publication Data

US 2010/0269533 A1 Oct. 28, 2010

(30) Foreign Application Priority Data

Dec. 14, 2007 (KR) ..... 10-2007-0131433
Dec. 14, 2007 (KR) ..... 10-2007-0131435

(51) Int. Cl.
*F25C 5/18* (2006.01)
*F25C 5/00* (2006.01)
*F25C 5/04* (2006.01)

(52) U.S. Cl.
CPC ..... *F25C 5/046* (2013.01); *F25C 5/005* (2013.01); *F25C 2400/10* (2013.01)
USPC ..... 62/344; 62/71; 62/320; 62/354

(58) Field of Classification Search
USPC ..... 62/344, 71, 320, 353, 354, 377, 459; 241/DIG. 17; 222/146.6
See application file for complete search history.

(56) References Cited

U.S. PATENT DOCUMENTS 4,176,527 A 12/1979 Linstromberg et al.
5,947,342 A 9/1999 Song (Continued)

FOREIGN PATENT DOCUMENTS

CN 1868744 A 11/2006
JP 8003394 B 1/1996

(Continued)

OTHER PUBLICATIONS

Chinese Office Action dated Sep. 8, 2011 for Application No. 200880120993.9, in English, 8 pages.

(Continued)

*Primary Examiner* — Allana Lewin
*Assistant Examiner* — Raheena Rehman
(74) *Attorney, Agent, or Firm* — Fish & Richardson P.C.

(57) ABSTRACT

An ice bank for a refrigerator, comprises: an ice bank body having an ice-crushing unit and a discharging passage; and a mode conversion apparatus disposed in the ice bank body for guiding ice cubes to the ice-crushing unit, or guiding the ice cubes to the discharging passage for discharge in a non-crushed state, wherein the mode conversion apparatus comprises: a guide member rotatably disposed in the ice bank body for guiding ice cubes to the ice-crushing unit, or to the discharging passage for discharge in a non-crushed state; an elastic member for elastically supporting the guide member; and a driving unit for generating a driving force so as to rotate the guide member. Accordingly, ice cubes can be dispensed in a non-crushed state or in a crushed state, and limitations in installation places of the ice bank can be reduced.

18 Claims, 14 Drawing Sheets

(56) References Cited

U.S. PATENT DOCUMENTS

| | | | | |
|---|---|---|---|---|
| 6,425,259 | B2 * | 7/2002 | Nelson et al. | 62/344 |
| 7,111,473 | B2 * | 9/2006 | Chung et al. | 62/320 |
| 7,266,951 | B2 * | 9/2007 | Anselmino et al. | 62/66 |
| 2005/0044874 | A1 | 3/2005 | Lee et al. | |
| 2006/0248912 | A1 * | 11/2006 | Park et al. | 62/344 |
| 2007/0113578 | A1 * | 5/2007 | Wu et al. | 62/344 |
| 2008/0156826 | A1 * | 7/2008 | Kim et al. | 221/258 |

FOREIGN PATENT DOCUMENTS

| | | | |
|---|---|---|---|
| KR | 10-0239520 | B1 | 1/2000 |
| KR | 10-0276738 | B1 | 2/2001 |
| KR | 10-20070103243 | A | 10/2007 |
| KR | 10-0777293 | B1 | 11/2007 |
| KR | 10-0780836 | B1 | 11/2007 |
| WO | WO 2007120015 | A1 * | 10/2007 |
| WO | WO2008/032986 | A1 | 3/2008 |

OTHER PUBLICATIONS

International Search Report dated Jun. 29, 2009 for Application No. PCT/KR2008/007337, 2 pages.

Korean Office Action issued in Application No. 2007-131435, mailed Apr. 23, 2009, 3 pages.

* cited by examiner

REFRIGERATOR

TECHNICAL FIELD

The present invention relates a refrigerator, and more particularly, to a refrigerator capable of dispensing ice cubes in a non-crushed state or in a crushed-state.

BACKGROUND ART

Generally, a refrigerator serves to store food items such as meat, fish, vegetables, fruits, and beverages with a fresh state for a long time. The refrigerator includes a refrigerator body having cooling chambers therein such as a freezing chamber, a refrigerating chamber, and a vegetable chamber, doors for opening and closing the cooling chambers, and a refrigeration cycle for providing cool air to the cooling chambers.

As the refrigeration cycle, is being currently used a so-called 'vapor compression-type refrigeration cycle' consisting of a compressor for compressing a refrigerant, a condenser for emitting heat thereby condensing the compressed refrigerant, an expander for expanding the refrigerant, and an evaporator for evaporating the refrigerant by absorbing peripheral heat.

Once the temperature of the freezing chamber or the refrigerating chamber increases to a temperature more than a preset temperature, the refrigeration cycle is operated. As the refrigeration cycle is operated, the evaporator forms cool air, and the cool air circulates through the freezing chamber and the refrigerating chamber by an operation of a cooling fan.

As the cool air circulates through the freezing chamber and the refrigerating chamber, the freezing chamber, the refrigerating chamber, and the vegetable chamber provided with the refrigerating chamber maintain preset temperatures.

The refrigerator may be classified into various types according to methods for circulating cool air, positions of the freezing chamber and the refrigerating chamber, configurations of the evaporator, etc.

The refrigerator may be provided with various functions so as to enhance a user's convenience and satisfaction degree.

For instance, the refrigerator is provided with an ice making system (or apparatus) for making ice cubes.

The ice making system may include an icemaker for making ice cubes, and an ice bank positioned below the icemaker for storing ice cubes made by the icemaker.

The icemaker may be mounted at an inner side of a door, or inside the freezing chamber. And, the icemaker may be detachably configured. An ice-crushing unit for crushing ice may be provided at a part of the ice bank.

However, when the ice bank for a refrigerator is provided with the ice-crushing unit, the ice bank has an increased entire thickness thus to have a difficulty in being mounted to the door.

Furthermore, in this case, it is difficult to detach the ice bank from the door. And, when the ice bank is detached from the door, ice cubes stored therein may be discharged out.

DISCLOSURE OF THE INVENTION

Therefore, it is an object of the present invention to provide an ice bank for a refrigerator capable of dispensing ice cubes in a non-crushed state or in a crushed-state, and capable of reducing limitations in installation places.

It is another object of the present invention to provide an ice bank for a refrigerator capable of being easily detached, and capable of preventing ice cubes from being discharge out when detaching the ice bank.

To achieve these and other advantages and in accordance with the purpose of the present invention, as embodied and broadly described herein, there is provided an ice bank for a refrigerator, comprising: an ice bank body having an ice-crushing unit and a discharging passage; and a mode conversion apparatus disposed in the ice bank body for guiding ice cubes to the ice-crushing unit, or guiding the ice cubes to the discharging passage for discharge in a non-crushed state, wherein the mode conversion apparatus comprises: a guide member rotatably disposed in the ice bank body for guiding ice cubes to the ice-crushing unit, or guiding the ice cubes to the discharging passage for discharge in a non-crushed state; an elastic member for elastically supporting the guide member; and a driving unit for generating a driving force so as to rotate the guide member.

The mode conversion apparatus may further comprise a curved lever rotatably disposed between the driving unit and the guide member, for rotating the guide member by a driving force generated from the driving unit.

The curved lever may comprise a coupling shaft portion having a predetermined length and outer diameter, and rotatably coupled to one side of the ice bank body; a first curved shaft portion curvedly-extending from one side of the coupling shaft portion; a locking shaft portion curvedly-extending from the first curved shaft portion, and connected to the driving unit; a second curved shaft portion curvedly-extending from another side of the coupling shaft portion; and a connection shaft portion curvedly-extending from the second curved shaft portion, and connected to the guide member.

The guide member may comprise a guide portion for guiding ice cubes; a rotatable coupling portion formed at one side of the guide portion, and rotatably coupled to the ice bank body; and a locking portion extending from the guide portion for locking a part of the curved lever.

A position limitation portion for limiting a motion of the guide portion may be provided at one side of the guide portion.

The locking portion may be formed at an intermediate part of the guide portion.

A body coupling portion for moveably coupling the guide member may be provided at one side of the ice bank body. And, the body coupling portion may comprise two fixed plate portions protruding from one side of the ice bank body with a gap therebetween; pin holes penetratingly formed at the fixed plate portions; and a through hole penetratingly formed between the two fixed plate portions, for inserting one side of the guide member.

The elastic member may be implemented as a torsion spring.

The driving unit may comprise an actuator for generating a linear reciprocation driving force.

A hook for positioning one side of the curved lever may be provided inside a shaft of the actuator.

The ice bank for a refrigerator may further comprise a detachable-mounting apparatus for detachably mounting the ice bank body to a refrigerator body or a refrigerator door.

A base member for horizontally inserting the ice bank body is provided at the refrigerator body or the refrigerator door. And, the detachable-mounting apparatus may comprise: a rotation shaft portion rotatably coupled to the base member; a cover disposed at one side of the rotation shaft portion so as to have a predetermined area, for covering an opened part formed by the ice bank and the base member when the ice bank is inserted into the base member; and a detachable-mounting unit disposed at the base member and the ice bank, for detachably mounting the ice bank to the base member by interworking with the cover when the ice bank is inserted into or separated from the base member; and an elastic member for elastically supporting the cover.

The rotation shaft portion may comprise first and second supporting portions protruding from one side surface of the cover with a gap therebetween; and a shaft portion formed at the first and second supporting portions, extending toward an outer side of the cover, and rotatably supported by first and second rotation supporting portions of the base member.

An insertion portion for inserting the elastic member may be formed by cutting one side of the shaft portion by a predetermined length.

The detachable-mounting unit may comprise: a curved-line guide groove penetratingly formed at a lower surface of the base member in the form of a curved-line; a guide rod curvedly-extending from one side of the rotation shaft portion in the form of a curved-line, and having a locking guide protrusion at one side thereof, the locking guide protrusion protruding so as to be inserted into the curved-line guide groove; and a guide locking portion disposed on a lower surface of the ice bank, and locked by or unlocked from the locking guide protrusion with moving the locking guide protrusion when the ice bank is inserted into or separated from the base member.

The locking guide protrusion may be formed such that a sectional surface thereof has a semi-circular shape.

The detachable-mounting unit may comprise an elastic hook curvedly-protruding from one side surface of the cover, and having an elastic force; and a curved-line shaped locking protrusion protruding from one side of the ice bank in the form of a curved-line, and engaged with the elastic hook.

The elastic hook may comprise a first curved-line portion protruding from one side surface of the cover; a second curved-line portion curvedly-extending from the first curved-line portion; a third curved-line portion curvedly-extending from the second curved-line portion by a predetermined length; and a locking portion curvedly-extending from the third curved-line portion.

The curved-line shaped locking protrusion may be formed in a shape corresponding to the first curved-line portion.

The curved-line shaped locking protrusion may be configured such that an end portion thereof comes in contact with the locking portion to restrict a motion of the elastic hook.

As aforementioned, in the present invention, ice cubes can be dispensed in a non-crushed state or in a crushed state, and limitations in installation places can be solved. Accordingly, the ice bank for a refrigerator can be suitably mounted to the refrigerator door.

Furthermore, the ice bank can be easily detachable-mounted to the refrigerator body or the refrigerator door. And, when the ice bank is detached from the refrigerator body or the refrigerator door, ice cubes stored therein may not be discharged out.

MODES FOR CARRYING OUT THE PREFERRED EMBODIMENTS

Reference will now be made in detail to the preferred embodiments of the present invention, examples of which are illustrated in the accompanying drawings.

Hereinafter, an ice bank for a refrigerator according to the present invention will be explained in more detail with reference to the attached drawings.

Figure 1:
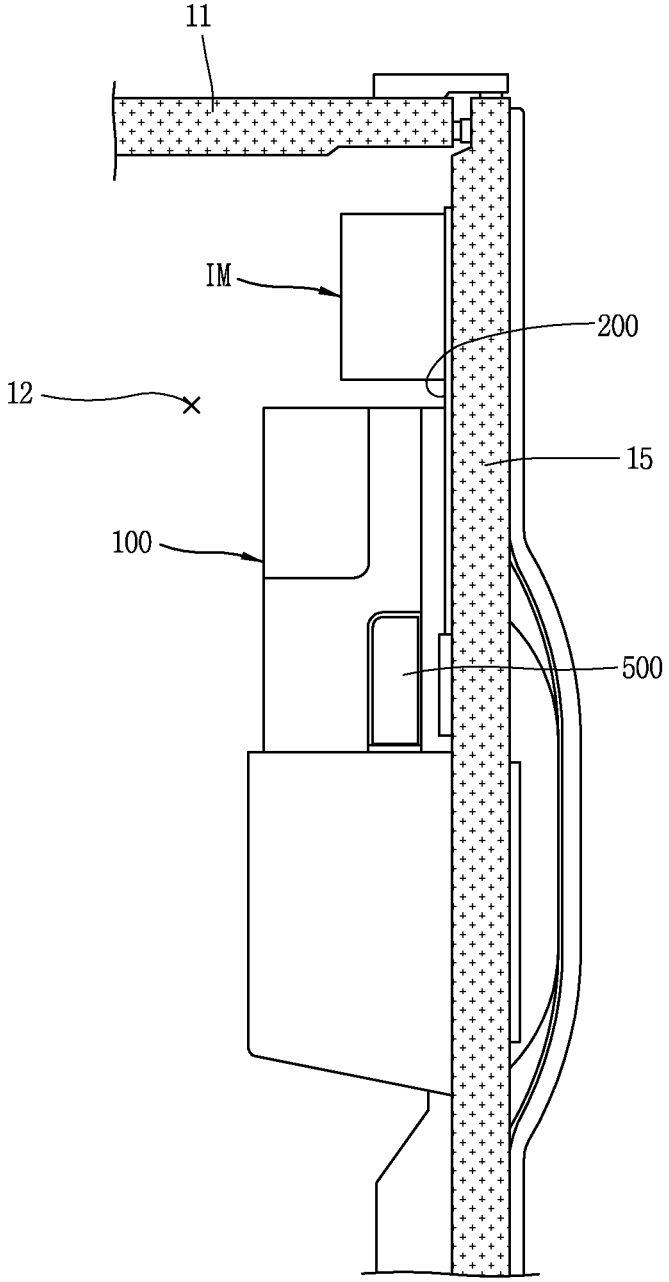
FIG. 1 is a side sectional view showing a mounted state of an ice bank for a refrigerator according to a first embodiment of the present invention.
Figure 2:
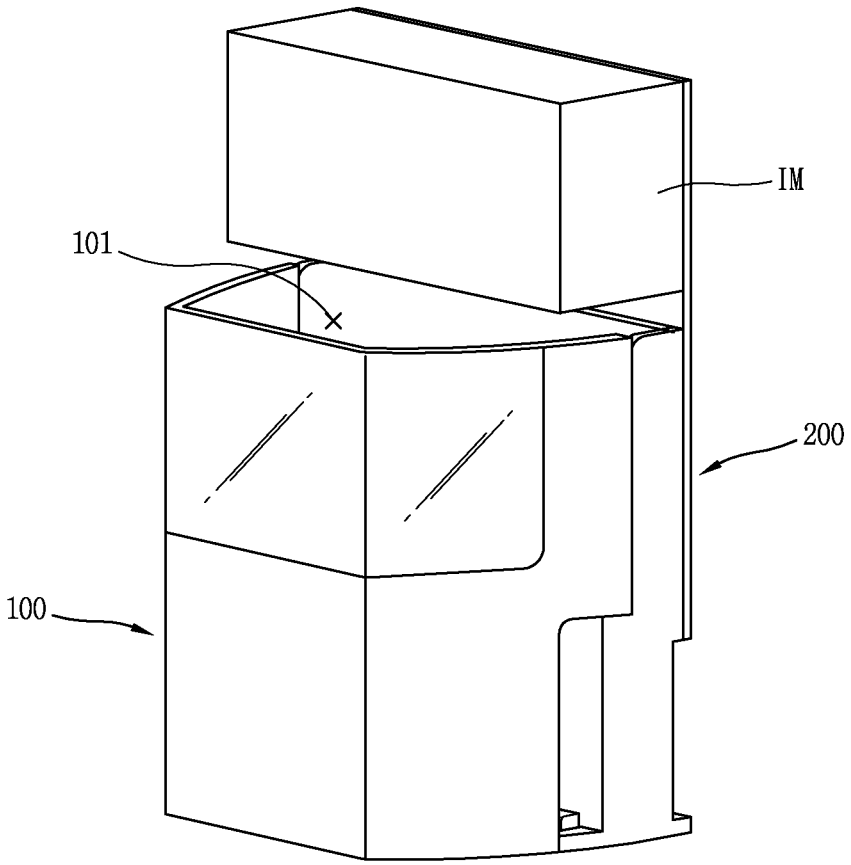
FIG. 2 is a perspective view showing a coupled state between the ice bank of FIG. 1 and a base member.
Figure 3:
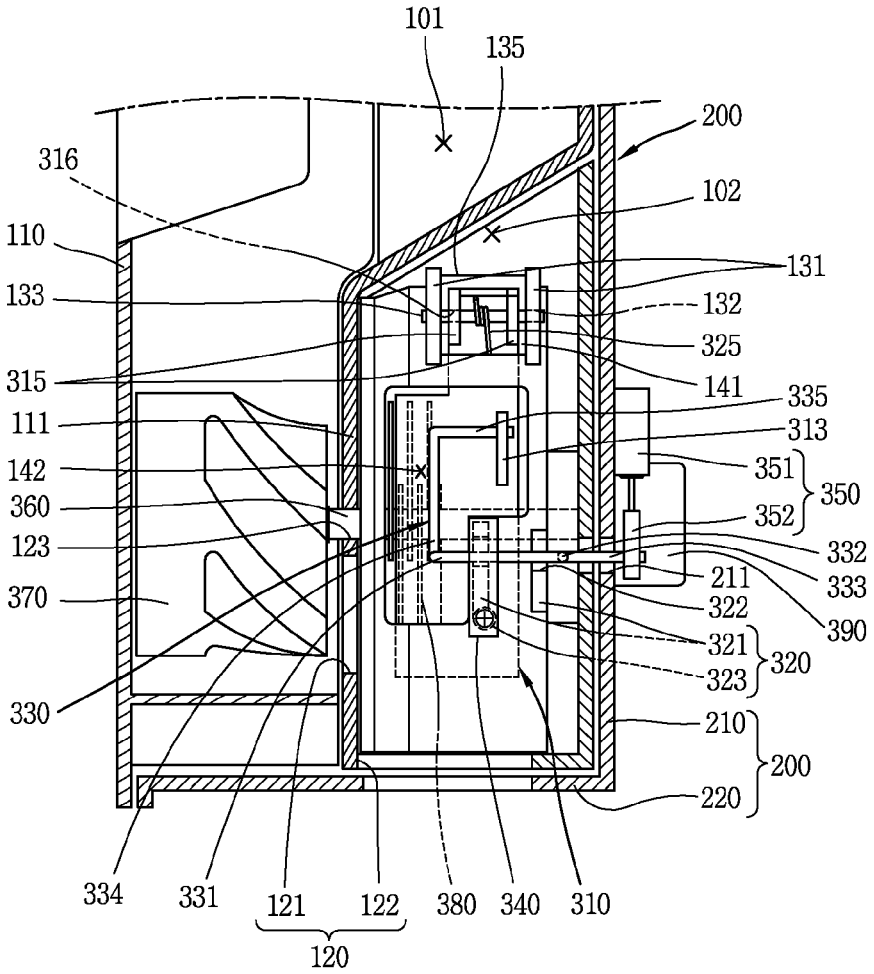
FIG. 3 is a partial side sectional view of the ice bank of FIG. 2.

As shown in FIG. 3, an ice bank 100 for a refrigerator comprises an ice bank body 110 having an ice-crushing unit 380 and a discharging passage 120; and a mode conversion apparatus disposed in the ice bank body 110 for guiding ice cubes to the ice-crushing unit 380, or guiding the ice cubes to the discharge passage 120 for discharge in a non-crushed state. Here, as shown in FIGS. 1 and 2, the ice bank body 110 may be detachably coupled to a base member 200, and the base member 200 may be detachably coupled to a refrigerator body 11 or a refrigerator door 15. Hereinafter, will be explained a case that the base member 200 is coupled to the refrigerator door 15.

The ice bank 100 for a refrigerator according to the present invention may further comprise a detachable-mounting apparatus disposed at the ice bank body 110 and the base member 200, respectively, for detachably mounting the ice bank body 110 to the base member 200.

Hereinafter, the mode conversion apparatus will be firstly explained, and the detachable-mounting apparatus will be later explained.

As shown in FIGS. 2 and 3, the ice bank 100 for a refrigerator comprises an ice bank body 110 having a storage space 101 of which an upper surface is opened, a detachable-mounting apparatus (not shown) for detachably mounting the ice bank body 110 to the base member 100, a mounting space 102 disposed below the ice bank body 110 so as to be communicated with the storage space 101, and a discharging passage 120 through which ice cubes stored in the storage space 101 are discharged out. Here, an unexplained reference number 12 denotes a cooling chamber and an unexplained reference number 500 denotes a cover of the detachable-mounting apparatus, which will be later explained.

The discharging passage 120 includes a communication hole 121 formed below a partition wall 111 between the mounting space 102 and the storage space 101; and a discharge opening 122 penetratingly formed at lower surfaces of the storage space 101 and the ice bank body 110, and communicated with the storage space 101.

Preferably, the communication hole 121 is formed in a fan shape, and is provided with a shaft supporting groove 123 extending from one side thereof for supporting a shaft.

As shown in FIG. 3, the base member 200 includes a vertical base portion 210 having a predetermined area and coupled to an inner wall of the refrigerator door 15, and a horizontal base portion 220 curvedly-extending from a lower end of the vertical base portion 210 and having a predetermined area.

A detachable-mounting apparatus (riot shown) is provided at the vertical base portion 210 and the horizontal base portion 220 of the base member 200. The ice bank 100 comprises a detachable-mounting apparatus formed at the ice bank 100 and the base member 200, respectively, for detachably mounting the ice bank 100 to the base member 200 by horizontally inserting the ice bank 100 into the base member 200.

A guide member 310 for selectively guiding ice cubes is movably coupled to the ice bank body 110.

Figure 4:
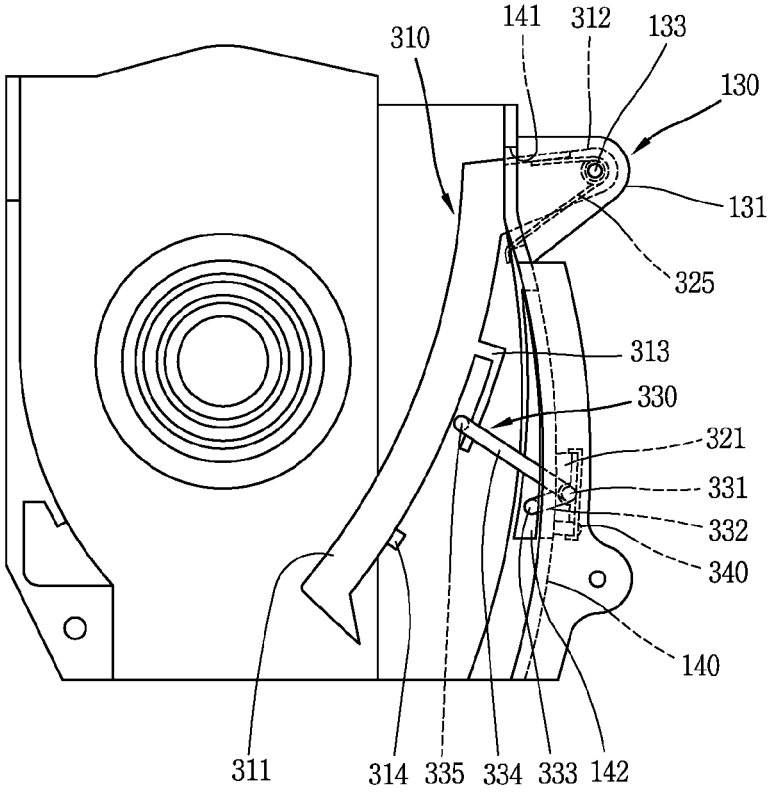
FIG. 4 is a frontal view of FIG. 3.

As shown in FIG. 4, the guide member 310 includes a guide portion 311 formed to have a predetermined size; a rotatable coupling portion 312 formed at one side of the guide portion 311, and rotatably coupled to one side of the ice bank body 110; and a locking portion 313 extending from the guide portion 311.

Preferably, the locking portion 313 is formed at an intermediate part of the guide portion 311, and the locking portion 313 is protruding with a shape of reversed 'L'.

A position limitation portion 314 for limiting a motion of the guide portion 311 may be provided at one side of the guide portion 311. Preferably, the position limitation portion 314 is protruding from one side of the guide portion 311 by a predetermined length so as to limit a motion of the guide portion 311 by being locked by one side of an inner wall of the mounting space 102 when the guide portion 311 is moved. Various configurations may be implemented to limit a motion of the guide portion 311.

A body coupling portion 130 for moveably coupling the guide member 310 is provided at one side of the ice bank body 110.

Preferably, the body coupling portion 130 is formed on an outer side surface of a side surface plate 140 that forms the mounting space 102. The body coupling portion 130 may comprise two fixed plate portions 131 protruding from an outer side surface of the side surface plate 140 with a predetermined gap therebetween; pin holes 132 penetratingly formed at the fixed plate portions 131; and an upper through hole 141 penetratingly formed between the two fixed plate portions 131, for inserting one side of the guide member 310. The two fixed plate portions 131 may be provided with a supporting plate portion 135 for supporting the two fixed plate portions 131 by connecting them to each other.

The rotatable coupling portion 312 of the guide member 310 includes two insertion plate portions 315 extendingly formed on one side of an outer surface of the guide portion 311 so as to have a predetermined area, and pin holes 316 penetratingly formed at the two insertion plate portions 315. A gap between the two insertion plate portions 315 is smaller than a gap between the two fixed plate portions 131.

The guide portion 311 of the guide member 310 is inserted into the upper through hole 141 of the body coupling portion 130 so that the rotatable coupling portion 312 can be outwardly protruding, and so that the guide portion 311 can be positioned in the mounting space 102. The insertion plate portions 315 of the rotatable coupling portion 312 are positioned between the fixed plate portions 131. Under a state that the pin holes 316 of the insertion plate portions 315 are aligned to the pin holes 132 of the fixed plate portions 131, a connection pin 133 is inserted into the pin holes 132 and 316.

As another embodiment of the rotatable coupling portion 312, protrusions (not shown) may be protrudingly formed at an outer side of the insertion plate portions 315. And, the protrusions may be configured to be rotatably inserted into the pin holes 132 of the fixed plate portions 131.

An elastic member 325 for elastically supporting the guide member 310 is coupled to the body coupling portion 130 of the ice bank 100.

Preferably, the elastic member is implemented as a torsion spring.

The torsion spring is formed as a middle part of a wire having a predetermined length is roundly wound a plurality of times, and the connection pin is inserted into the middle wound part. One end of the torsion spring is supported by the rotatable coupling portion 312 of the guide member 310, and another side thereof is supported by one side of the ice bank body 110. As the guide member 310 is supported by an elastic force of the torsion spring, an opposite side to the rotatable coupling portion 312 serving as a hinge shaft is moved toward a center of the mounting space 102 by the elastic force. A moving width of the guide member 310 is limited by the position limitation portion 314.

A curved lever 330 having a predetermined shape is rotatably coupled to one side of the ice bank body 110. Preferably, the curved lever 330 is formed by bending a wire having a predetermined length and outer diameter.

The curved lever 330 may comprise a coupling shaft portion 331 having a predetermined length and outer diameter, and rotatably coupled to one side of the ice bank body 110; a first curved shaft portion 332 curvedly-extending from one side of the coupling shaft portion 331; a locking shaft portion 333 curvedly-extending from the first curved shaft portion 332; a second curved shaft portion 334 curvedly-extending from another side of the coupling shaft portion 331; and a connection shaft portion 335 curvedly-extending from the second curved shaft portion 334, and connected to the guide member 310.

A lower through hole 142 is formed on the side surface plate 140 that forms the mounting space 102 of the ice bank, with a predetermined gap from the upper through hole 141. And, a mounting portion 320 to which the coupling shaft portion 331 of the curved lever 330 is rotatably coupled is provided next to a lower part of the lower through hole 142.

The mounting portion 320 is composed of two supporting protrusions 321 protruding from the side surface plate 140 so as to have a predetermined area. And, a supporting groove 322 for inserting the coupling shaft portion 331 of the curved lever 330 is formed at the supporting protrusions 321.

The coupling shaft portion 331 of the curved lever 330 is inserted into the supporting groove 322 of the mounting portion 320, and the second curved shaft portion 334 is inserted into the lower through hole 142. Under these configurations, the connection shaft portion 335 is coupled to the locking portion 313 of the guide member 310, and the first curved shaft portion 332 is positioned on an outer side of a rear plate of the mounting space 102 toward the center of the mounting space 102. And, the locking shaft portion 333 is positioned in perpendicular to the rear surface plate.

Preferably, a boss 323 having a predetermined height and having a screw hole therein is disposed below the supporting protrusion 321, and a supporting plate 340 is coupled to the boss 323 by a screw. Accordingly, the supporting plate 340 covers a part of the coupling shaft portion 331 of the curved lever 330, thereby fixing the coupling shaft portion 331.

A driving unit 350 for moving one side of the curved lever 330 is mounted to the ice bank 100 or the base member 200. Preferably, the driving unit 350 is mounted to the base member 200.

The driving unit 350 may include an actuator 351 for generating a driving force; and a socket 352 coupled to a shaft of the actuator 351, for positioning therein one side of the locking shaft portion 333 of the curved lever 330. The actuator 351 may be mounted to a rear surface of the base member 200. The actuator 351 may be configured to push or pull the curved lever 330. In the preferred embodiment, the actuator 351 is configured to upwardly pull the locking shaft portion 333 of the curved lever 330.

A through hole 211 having a predetermined size is formed at one side of the vertical base portion 210 of the base member 200, and the socket 352 is positioned in the through hole 211.

When the ice bank 300 is inserted into the base member 200, a part of the locking shaft portion 333 of the curved lever 330 is positioned in the socket 352.

Once the actuator 351 is operated under a state that the ice bank 300 has been inserted into the base member 200, the socket 352 connected to the actuator 351 is vertically moved, thereby vertically moving the locking shaft portion 333 of the curved lever 330 inside the socket 352.

A transfer unit for transferring ice cubes is provided below the storage space 101 of the ice bank, and an ice-crushing unit for crushing ice cubes is provided at the mounting space 102. The transfer unit and the ice-crushing unit may be configured as one assembly.

The assembly of the transfer unit and the ice-crushing unit will be explained.

The assembly includes a rotation shaft 360 penetratingly inserted into a lower part of the ice bank body 110; a transfer unit 370 disposed below the storage space 101 of the ice bank 100 and coupled to the rotation shaft 360, for transferring ice cubes by being rotated; an ice-crushing unit 380 disposed in the mounting space 102 and coupled to the rotation shaft 360, for selectively crushing ice cubes by being rotated; and a driving motor 390 mounted to the base member 200. Here, a connection unit for transmitting a driving force by being detachably connected to the rotation shaft 360 and a rotation shaft of the driving motor 390 may be provided between the rotation shaft 360 and the rotation shaft of the driving motor 390. The connection unit is formed so as to be detachably coupled to the driving motor 390 in an axial line direction, and so that the rotation shaft 360 and the rotation shaft of the driving motor 390 can be coupled to each other in a rotation direction, thereby transmitting a rotation force of the driving motor 390 to the rotation shaft 360.

The transfer unit 370 includes a screw, and the ice-crushing unit 380 includes a plurality of cutters.

One side of the rotation shaft 360 is supported by being inserted into the shaft supporting groove 123 formed at a partition wall between the storage space 101 and the mounting space 102, and another side of the rotation shaft 360 is supported by a rear surface of the ice bank body 110. A first connection unit 460 (refer to FIG. 8) of the connection unit is coupled to the end of the rotation shaft 360 disposed on the rear surface side of the ice bank body 110 of the ice bank 100. And, a second connection unit 395 (refer to FIG. 7) detachably coupled to the first connection unit 460 of the connection unit may be formed at the rotation shaft of the driving motor 390.

The first connection unit 460 and the second connection unit 395 are connected to each other when the ice bank 100 is coupled to the base member 200, but are separated from each other when the ice bank 100 is separated from the base member 200.

The ice-crushing unit 380 is positioned at a middle part of the mounting space 102, and the guide member 310 is positioned at a middle side of the mounting space 102 when not operated.

The ice bank 300 may be implemented as a plurality of components are assembled to each other.

Figure 5:
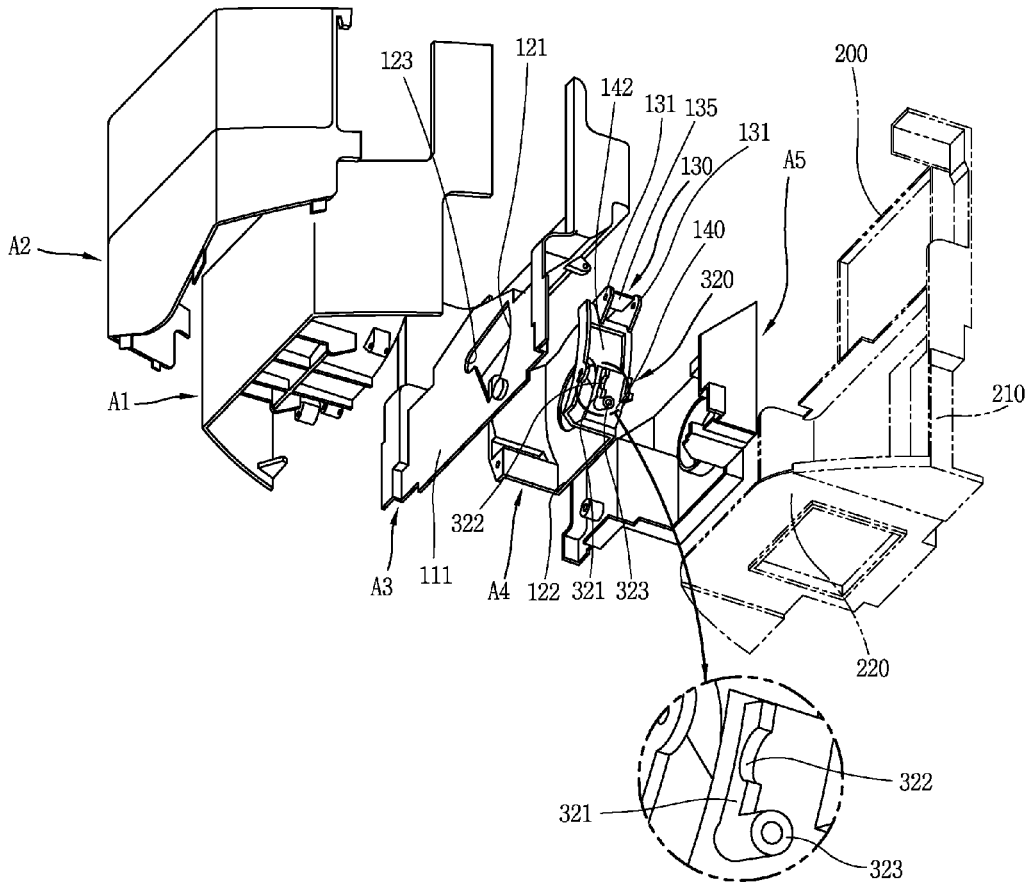
FIG. 5 is an exploded perspective view of the ice bank of FIG. 2.

Referring to FIG. 5, the ice bank 300 includes a front bucket (A1) that forms a part of lower and front surfaces; a window tray (A2) coupled to the front bucket (A1) and forming a front surface together with the front bucket (A1); a rear bucket (A3) coupled to the front bucket (A1), and forming the storage space 101 for storing ice cubes together with the window tray (A2) and the front bucket (A1); a blade cover (A4) coupled to a lower part of the rear bucket (A3), and forming the mounting space 102; and a bucket cover (A5) coupled to the rear bucket (A3) so as to cover the blade cover (A4).

A lower part of the rear bucket (A3) serves as the partition wall 111 that partitions the storage space 101 and the mounting space 102 from each other, and the communication hole 121 is formed at a lower part of the rear bucket (A3).

At the side surface plate 140 of the blade cover (A4), provided are the body coupling portion 130, the upper through hole 141, the lower thorough hole 142, the mounting portion 320, and the discharge opening.

Unexplained reference numeral 'IM' denotes an icemaker.

The operation of the ice bank for a refrigerator will be explained.

Under a state that the base member 200 has been mounted to an inner wall of the refrigerator door 15, the ice bank 100 is inserted into the base member 200. Then, ice cubes are formed by the icemaker (IM), thus to be filled in the storage space 101 of the ice bank 100 by a preset amount.

Since the driving unit 350 is in a stopped state, the guide member 310 is positioned at a middle part of the mounting space 102, i.e., a side part of the ice-crushing unit 380 with being supported by an elastic force of the elastic member 325. Here, the guide member 310 does not move to any positions rather than the middle part of the mounting space 102 by the position limitation portion 314.

Ice cubes stored in the ice bank 100 are prevented from being discharged to the communication hole 121 by the transfer unit 370.

When discharging the ice cubes filled in the storage space 101 of the ice bank 100 out of the refrigerator through a dispenser (not shown) of the refrigerator door 15, it is selected whether to discharge the ice cubes through a discharging passage in a non-crushed state or in a crushed state.

Firstly, when discharging the ice cubes stored in the ice bank 100 through the discharging passage in a non-crushed state, the driving motor 390, and the driving unit 350 are operated.

As the driving unit 350 is operated, the hook of the driving unit 350 is upwardly moved, and the locking shaft portion 333 of the curved lever 330 inside the socket 352 is upwardly pulled.

Figure 6:
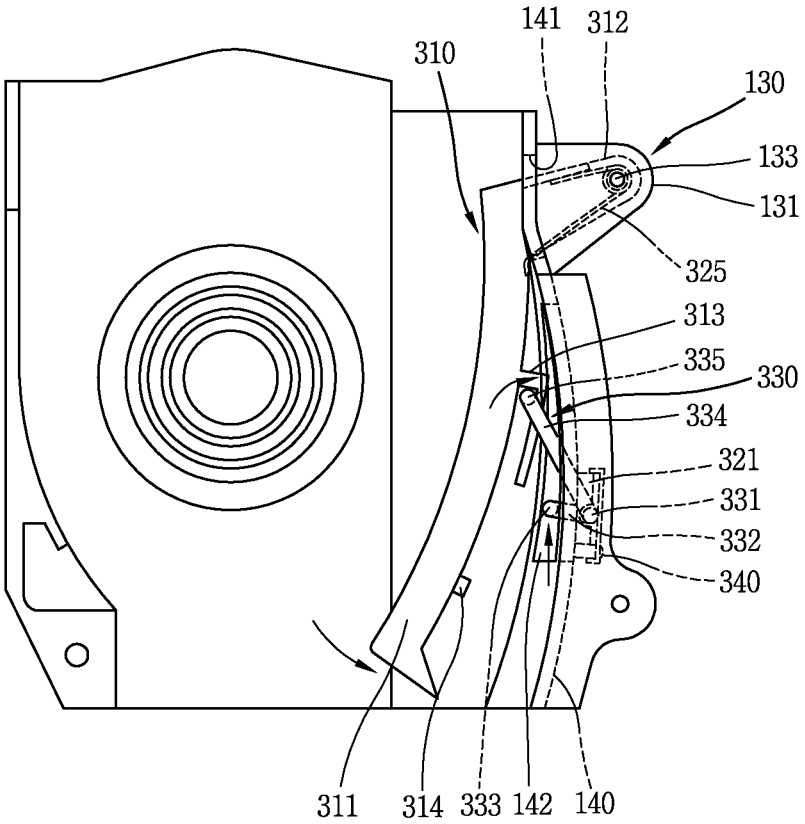
FIG. 6 is a frontal view showing an operational state of the ice bank of FIG. 2.

As the locking shaft portion 333 of the curved lever 330 is upwardly moved, the connection shaft portion 335 of the curved leer 330 is rotated centering around the coupling shaft portion 331 of the curved lever 330. At this time, as shown in FIG. 6, the guide member 310 is pulled toward the side surface plate 140 of the mounting space 102. While rotated centering around the rotatable coupling portion 312 by receiving an elastic force of the elastic member 325, the guide member 310 is moved toward the side surface plate 140.

Under these states, the rotation shaft 360 is rotated as the driving motor 390 is operated. As the rotation shaft 360 is rotated, the transfer unit 370 and the ice-crushing unit 380 coupled to the rotation shaft 360 are rotated. As the transfer unit 370 is rotated, the ice cubes stored in the ice bank 100 are introduced into the mounting space 102 through the communication hole 121, thereby being discharged through the discharge opening 122 without being stopped by the ice-crushing unit 380. The ice cubes introduced into the mounting space 102 are discharged to the discharge opening 122 without being stopped by the ice-crushing unit 380 since the guide member 310 has moved toward the side surface plate 140.

When discharging the ice cubes stored in the ice bank 100 through the discharging passage in a crushed state, the rotation shaft 360 is rotated as the driving motor 390 is operated under a state that the driving unit 350 is stopped. As the rotation shaft 360 is rotated, the transfer unit 370 and the ice-crushing unit 380 coupled to the rotation shaft 360 are rotated.

As the transfer unit 370 is rotated, the ice cubes stored in the ice bank 100 are introduced into the mounting space 102 through the communication hole 121. Then, the ice cubes introduced into the mounting space 102 are moved to the ice-crushing unit 380 by the guide member 310, thereby being crushed by the ice-crushing unit 380. The guide member 310 is positioned at an intermediate part of the mounting space 102 since the driving unit 350 is in a non-operated state, thereby guiding the ice cubes to the ice-crushing unit 380.

The ice cubes crushed by the ice-crushing unit 380 are discharged through the discharge opening 122.

In the present invention, the ice cubes moving in the storage space 101 of the ice bank 100 are guided to the ice-crushing unit 380, or are dispensed in a non-crushed state by driving the guide member 310 by the driving unit 350. Accordingly, the ice cubes can have sizes controlled by a user thus to be supplied.

Since the ice cubes stored in the ice bank 100 can have controlled sizes according to a user's request thus to be supplied, the use's convenience and product competitiveness are enhanced Hereinafter, the detachable-mounting apparatus of the ice bank for a refrigerator according to a first embodiment will be explained with reference to FIGS. 1 and 7~10.

Figure 7:
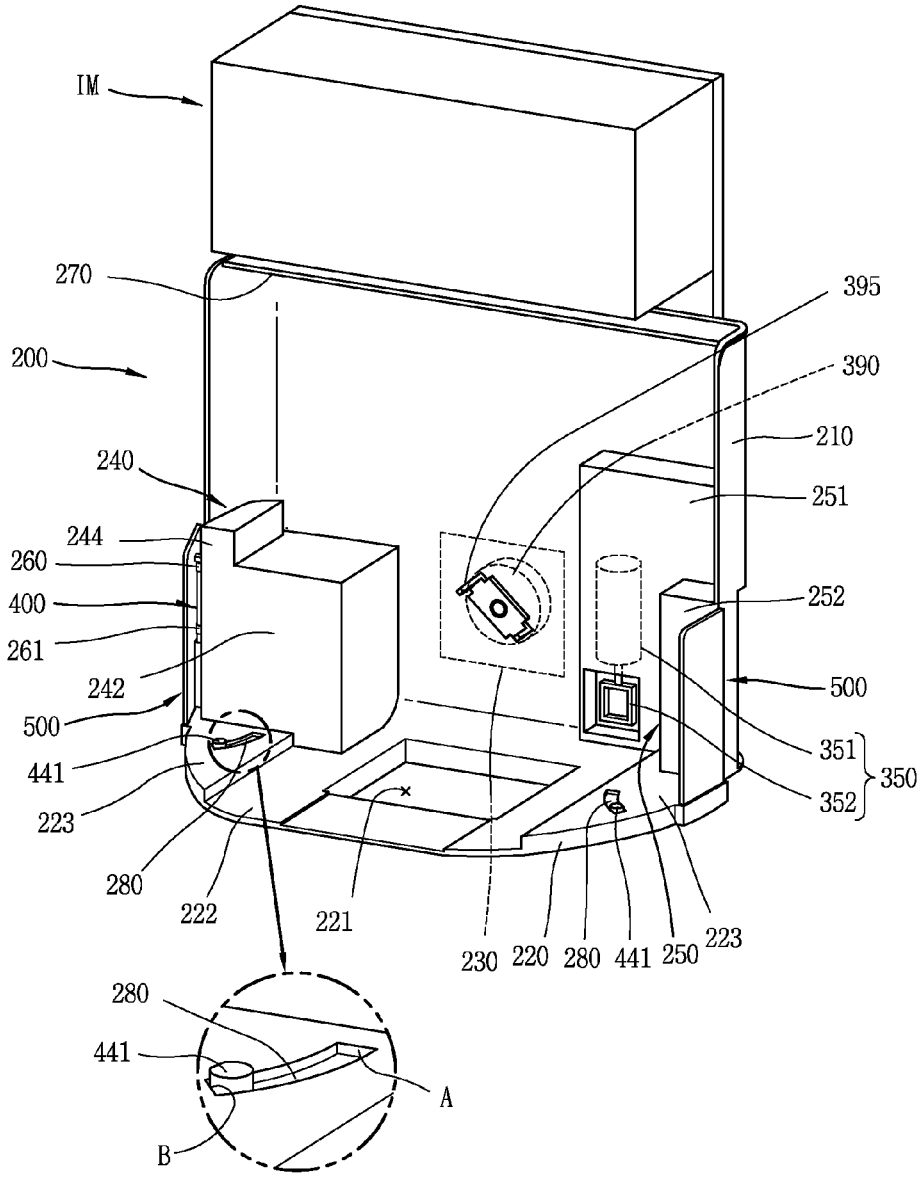
FIG. 7 is a perspective view showing a detachable-mounting unit of a detachable-mounting apparatus of the ice bank and the base member of FIG. 2.

Firstly, as shown in FIG. 7, the icemaker (IM) for making ice cubes is mounted to the base member 200 having a predetermined shape, and the ice bank 100 is coupled to the base member 200 so as to be slidable in a horizontal direction.

A rotation shaft portion 400 is rotatably coupled to the base member 200, and a cover 500 having a predetermined area is provided at one side of the rotation shaft portion 400.

There is provided a detachable-mounting unit for inserting or separating the ice bank 100 into/from the base member 200 by interworking with the cover 500. And, an elastic member 600 for elastically supporting the cover 500 is coupled to the rotation shaft portion 400.

The base member 200 includes a vertical base portion 210 having a predetermined area, and a horizontal base portion 220 curvedly-extending from a lower part of the vertical base portion 210 and having the discharge opening 221 penetratingly formed therein.

A horizontal supporting portion 222 for supporting the ice bank 100 by horizontally inserting into the base member 200 is provided at the horizontal base portion 220. The horizontal supporting portion 222 is implemented as a linear guide groove formed on an upper surface of the horizontal base portion 220 with a predetermined width and depth. Stepped surfaces 223 are formed at both sides of the linear guide groove. When coupling the ice bank 100 to the base member 200, a lower part of the ice bank 100 is slidingly-inserted into the horizontal supporting portion 222.

A vertical supporting portion for supporting the ice bank 100 by horizontally inserting into the base member 200 is provided at the vertical base portion 210. The vertical supporting portion is composed of a left supporting portion 240 formed on a front surface of the horizontal base portion 220, and a right supporting portion 250 spacing from the left supporting portion 240 with a predetermined gap.

The left supporting portion 240 is composed of a first protrusion portion 242 protruding from the vertical base portion 210 in a hexahedron shape, and a second protrusion portion 244 extending from an upper surface of the first protrusion portion 242 with a step.

The right supporting portion 250 is composed of a first protrusion portion 251 protruding from the vertical base portion 210 in a hexahedron shape, and a second protrusion portion 252 extending from the first protrusion portion 251 in a hexahedron shape. The first protrusion portion 251 has a larger area than the second protrusion portion 252.

First and second rotation supporting portions 260 and 261 to which the rotation shaft portion 400 is rotatably coupled are provided at both sides of the vertical base portion 210 of the base member 200. The first rotation supporting portion 260 and the second rotation supporting portion 261 are provided with a predetermined gap therebetween in a vertical direction.

An upper supporting portion 270 for supporting an upper end of the ice bank 100 is formed above the vertical base portion 210 with a predetermined thickness and length.

Referring to FIG. 7, unexplained reference numeral 390 denotes a driving motor of the mode conversion apparatus, and 395 denotes a second connection unit formed at a rotation shaft of the driving motor. The second connection unit 395 is coupled to the first connection unit 460 (refer to FIG. 8) formed at the end of the rotation shaft 360 of the mode conversion apparatus in an axial line direction, thereby transmitting a rotation force of the driving motor 390 to the rotation shaft 360.

Reference numeral 350 denotes a driving unit of the mode conversion apparatus, 351 denotes an actuator, and 352 denotes a socket coupled to the actuator.

Figure 9:
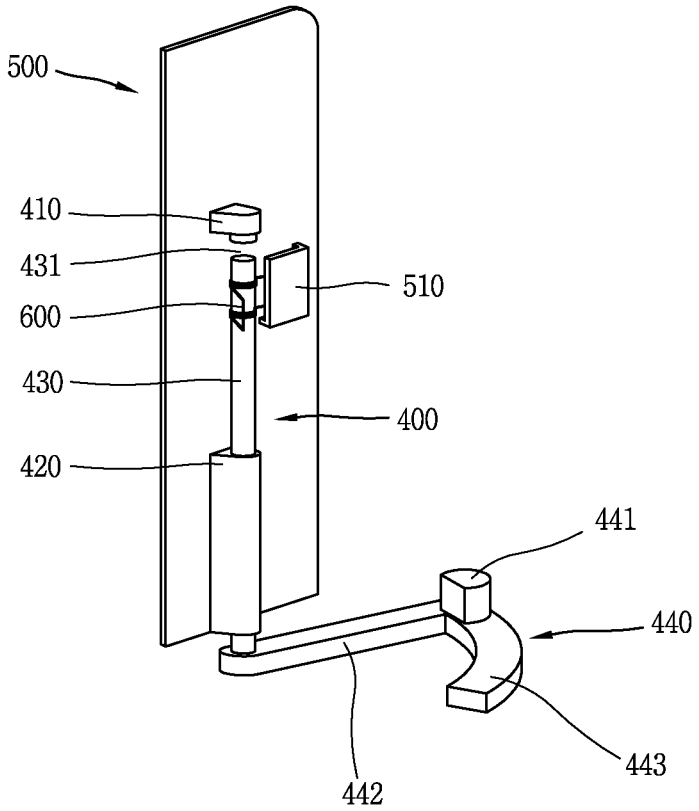
FIG. 9 is a perspective view showing the detachable-mounting apparatus of FIG. 7.

As shown in FIG. 9, the rotation shaft portion 400 includes first and second supporting portions 410 and 420 protruding from one side surface of the cover 500 with a predetermined gap therebetween; and a shaft portion 430 formed at the first and second supporting portions 410 and 420, and extending toward an outer side of the cover 500.

Preferably, the shaft portion 430 is provided with an insertion portion 431 for inserting the elastic member 600, the insertion portion 431 formed by cutting one side of the shaft portion 430 by a predetermined depth.

A longitudinal direction of the shaft portion 430 is equal to a longitudinal direction of the cover 500.

The shaft portion 430 of the rotation shaft portion 400 is rotatably coupled to the first and second rotation supporting portions 260 and 261 of the base member 200. Preferably, the first rotation supporting portion 260 comes in contact with a lower surface of the first supporting portion 410, and the second rotation supporting portion 261 comes in contact with an upper surface of the second supporting portion 420.

The elastic member 600 is preferably implemented as a torsion spring. For example, one wire is bent in a '⊂' shape, the '⊂'-shaped wire is bent in a right-angled shape, and the bent part is wound a plurality of times, thereby forming a torsion part.

The torsion part of the torsion spring is inserted into the shaft portion 430 of the rotation shaft portion 400. One side of the torsion spring is supported by the cover 500, and another side thereof is supported by one side of the vertical base portion 210 of the base member 200.

Preferably, the cover 500 is formed to have a predetermined area and thickness in a square shape. The first and second supporting portions 410 and 420 are formed at one side surface of the cover 500, and a fixing portion 510 for fixing one side of the torsion spring is formed at a side part of the cover 500. Preferably, the cover 500 and the rotation shaft portion 400 are integrally formed with each other.

The rotation shaft portion 400, the cover 500 and the elastic member 600 are provided at both sides of a front surface of the vertical base portion of the base member 200.

Figure 8:
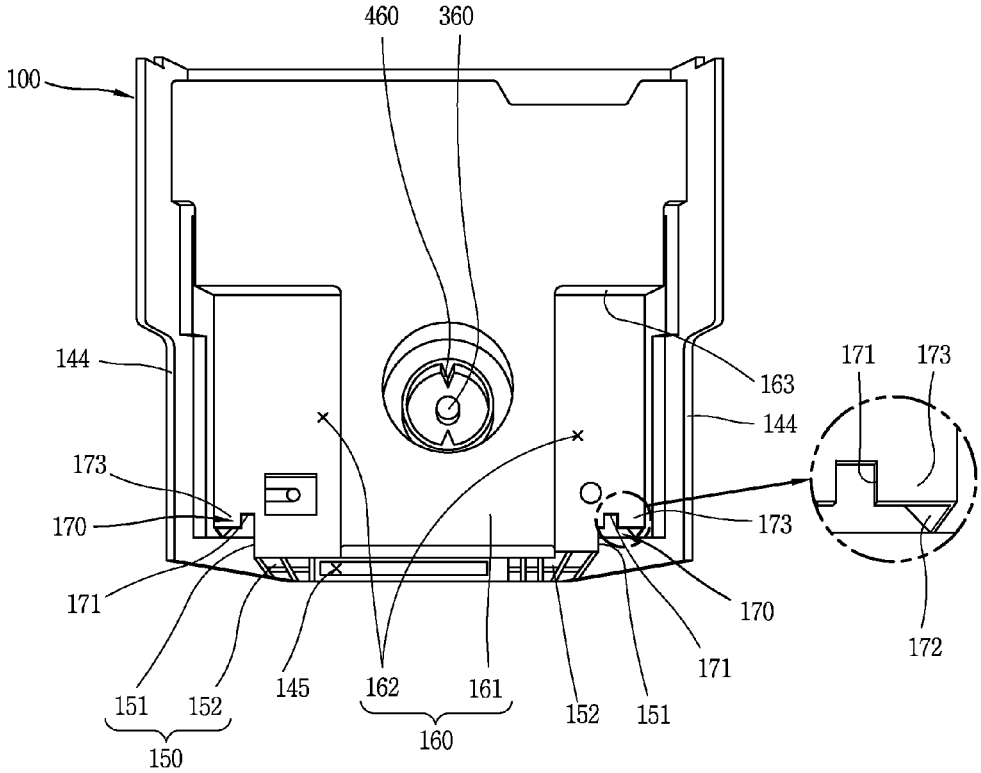
FIG. 8 is a perspective view showing a detachable-mounting unit of a detachable-mounting apparatus of the ice bank and the ice bank of FIG. 2.

As shown in FIG. 8, the ice bank 100 is provided therein with a storage space for storing ice cubes, and has two lower parts on a rear surface thereof concaved in a multi-step, respectively.

Due to the two concaved lower parts, there are provided, on the rear surface of the ice bank 100, a first insertion supporting portion 150 supported by being inserted into the horizontal supporting portion 222 of the horizontal base portion 220, and a second insertion supporting portion 160 supported by being inserted into the vertical supporting portion of the horizontal base portion 220.

The first insertion supporting portion 150 includes a stepped protrusion portion 151 formed with steps so as to have a width corresponding to a width of the horizontal supporting portion 222 of the horizontal base portion 220, the linear guide groove, at lower ends of the surfaces respectively concaved by one step at both sides of the rear surface of the ice bank 100; and a lower surface portion 152 of the stepped protrusion portion 151.

The second insertion supporting portion 160 includes a stepped protrusion portion 161 relatively protruding as both sides of the rear surface of the ice bank 100 are respectively concaved by one step; and a one-step concaved surface portion 162 formed as both sides of the ice bank 100 are respectively concaved by one step. A rear surface of the stepped protrusion portion 161 of the second insertion supporting portion 160 is the most protruding surface of the rear surface of the ice bank 100.

Recess portions 144 having a predetermined shape are formed at both edges of the rear surface of the ice bank 100. The recess portions 144 serve as holes into which a user's fingers are inserted when the ice bank 100 is coupled to the base member 200.

When the ice bank 100 is coupled to the base member 200, the first insertion supporting portion 150 and the second insertion supporting portion 160 of the ice bank 100 are slidingly-inserted into the horizontal supporting portion 222 and the vertical supporting portion of the base member 200. Here, the cover 500 coupled to the base member 200 covers the recess portions 144 of the ice bank 100.

The detachable-mounting unit includes a curved-line guide groove 280 penetratingly formed at a lower surface of the base member 200 in the form of a curved-line; a guide rod 440 curvedly-extending from one side of the rotation shaft portion 400 in the form of a curved-line, and having a locking guide protrusion 441 at one side thereof, the locking guide protrusion protruding so as to be inserted into the curved-line guide groove 280; and a guide locking portion 170 disposed on a lower surface of the ice bank 100, and locked by or unlocked from the locking guide protrusion 441 with moving the locking guide protrusion 441 when the ice bank 100 is inserted into or separated from the base member 200.

Preferably, as shown in FIG. 7, the curved-line guide groove 280 is formed at the stepped surface 223 of the base member 200. The curved-line guide groove 280 is formed in a curved-line having a predetermined width and length. One end of the curved-line guide groove 280 close to the vertical base portion 210 is referred to as 'A', and another end of the curved-line guide groove 280 far from the vertical base portion 210 is referred to as 'B'.

Preferably, the guide rod 440 is curvedly-extending from a lower end of the rotation shaft portion 400, and is perpendicular to the rotation shaft portion 400. Preferably, the guide rod 440 consists of a straight-line portion 442 curvedly-extending from a lower end of the rotation shaft portion 400 so as to have a predetermined length, and a curved-line portion 443 curvedly-extending from the end of the straight-line portion 442 in the form of a curved-line having a predetermined length. The straight-line portion 442 and the curved-line portion 443 are on the same plane. And, the locking guide protrusion 441 is formed on an upper surface of a boundary between the straight-line portion 442 and the curved-line portion 443.

Preferably, the locking guide protrusion 441 has a predetermined height, and has a semi-circular sectional surface.

The guide rod 440 is positioned on a lower surface of the stepped surface 223, and the locking guide protrusion 441 is inserted into the curved-line guide groove 280 to be upwardly protruding.

The guide locking portion 170 includes an opening groove 171 formed at a lower end of a rear surface of the ice bank 100, for passing the locking guide protrusion 441; and a locking protrusion 172 formed at a rear side of a surface of the ice bank 100 which contacts the stepped surface 223 of the base member 200, for locking the locking guide protrusion 441. A lower part of the rear surface of the ice bank where the opening groove is formed is referred to as a supporting surface 173.

Preferably, the locking protrusion has a triangular sectional surface.

The opening groove 171 of the guide locking portion 170 may be formed in the form of a curved-line having a predetermined length at a surface of the ice bank 100 contacting the stepped surface 223 of the base member 200.

Unexplained reference numeral 163 denotes an upper surface of a one-step concaved surface portion, and 145 denotes an outlet of the ice bank.

The operation of the ice bank for a refrigerator according to the first embodiment of the present invention will be explained.

Preferably, the base member 200 is mounted to an inner surface of a refrigerator door 15. The base member 200 may be mounted to a refrigerator body 11 so as to be positioned in a freezing chamber. Hereinafter, will be explained a case that the base member 200 is mounted to an inner surface of the refrigerator door 15.

Under a state that the base member 200 is fixedly-coupled to an inner wall of the refrigerator door 15, the vertical base portion 210 is positioned in a vertical direction, and a rear surface of the vertical base portion 210 is facing an inner surface of the refrigerator door 15. And, the horizontal base portion 220 of the base member 200 is positioned in a horizontal direction.

The rotation shaft portion 400 and the cover 500 are supported by an elastic force of the elastic member 600, and the locking guide protrusion 441 is positioned at the point of 'B' of the curved-line guide groove 280. And, the cover 500 is positioned on the edge of the horizontal base portion of the base member 200 along an outer circumferential surface.

Figure 10:
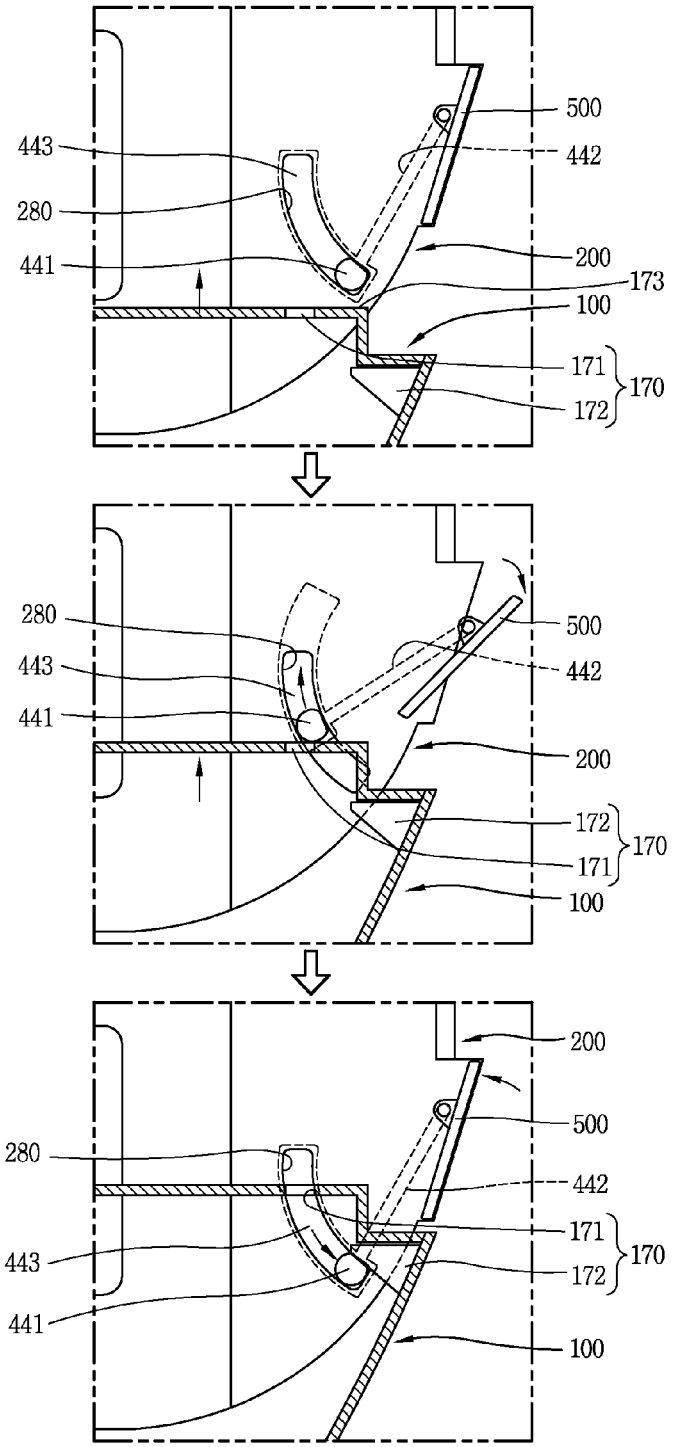
FIG. 10 is a planar view showing an operational state of the detachable-mounting apparatus of the ice bank of FIG. 2.

When a user is to couple the ice bank 100 to the base member 200, a lower surface of the ice bank 100 is positioned on an upper surface of the horizontal supporting portion 222 of the base member 200. Then, once the ice bank 100 is pushed in a horizontal direction, the ice bank 100 performs a horizontal sliding motion as shown in FIG. 10. Accordingly, the first insertion supporting portion 150 and the second insertion supporting portion 160 of the ice bank 100 are engaged with the horizontal supporting portion 222 and the vertical supporting portion of the base member 200, respectively. While the ice bank 100 is inserted into the base member 200, the locking guide protrusion 441 protruding to an upper side of the stepped surface is pressurized to come in contact with the supporting surface 173 of the ice bank 100. Accordingly, the locking guide protrusion 441 is moved in a direction of 'A' along the curved-line guide groove 280. When the locking guide protrusion 441 is moved, the rotation shaft portion 400 and the cover 500 are rotated as the cover 500 is interworked therewith.

Once the ice bank 100 is more pushed, the locking guide protrusion 441 is moved along the curved-line guide groove 280 and along the supporting surface 173. Once the locking guide protrusion 441 is positioned at the opening groove 171 of the supporting surface 173, the locking guide protrusion 441 is unlocked to be moved to the original position ('B') by an elastic force of the elastic member 600. Then, the locking guide protrusion 441 is disposed at one side of the locking protrusion 172 formed on a lower surface of the ice bank body 110 of the ice bank 100. Accordingly, when the ice bank body 110 is moved in a separated direction, the locking protrusion 172 and the locking guide protrusion 441 come in contact with each other, thereby preventing separation of the ice bank body 110.

Once the ice bank 100 is completely coupled to the base member 200, the cover 500 is rotated by an elastic force of the elastic member 600, thereby covering the recess portions 144 of the ice bank 100.

When a user is to separate the ice bank 100 from the base member 200 so as to use the ice cubes, the user pushes the covers 500 by using his both hands, thereby inserting the covers 500 into the recess portions 144 disposed at both sides of the ice bank 100. The pushed covers 500 are rotated centering around the rotation shaft portion 400, and the guide rod 440 and the locking guide protrusion 441 are interworked therewith thus to be moved along the curved-line guide groove 280. As the locking guide protrusion 441 is moved, a fixed state to the locking protrusion 172 is released. When the user pulls the ice bank 100 forwardly, i.e., in a horizontal direction with holding each one side of the recess portions 144 by using both hands, the ice bank 100 is horizontally moved to be separated from the base member 200. Once the ice bank 100 is completely separated from the base member 200, the locking guide protrusion 441 is moved to the original position by an elastic force of the elastic member 600.

When a user is to separate the ice bank 100 from the base member 200 so as to use the ice cubes, the user pushes the covers 500 by using his both hands, thereby inserting the covers 500 into the cutting portions 144 disposed at both sides of the ice bank 100. The pushed covers 500 are rotated centering around the rotation shaft portion 400, and the guide rod 440 and the locking guide protrusion 441 are interworked therewith thus to be moved along the curved-line guide groove 280. As the locking guide protrusion 441 is moved, a fixed state to the locking protrusion 172 is released. When the user pulls the ice bank 100 forwardly, i.e., in a horizontal direction with holding each one side of the cutting portions 144 by using both hands, the ice bank 100 is horizontally moved to be separated from the base member 200. Once the ice bank 100 is completely separated from the base member 200, the locking guide protrusion 441 is moved to the original position by an elastic force of the elastic member 600.

In order to couple the ice bank 100 to the base member 200, the ice bank 100 is inserted into the base member 200 in a pushing manner.

Hereinafter, a detachable-mounting apparatus of the ice bank for a refrigerator according to a second embodiment will be explained with reference to FIGS. 11 to 13.

Figure 11:
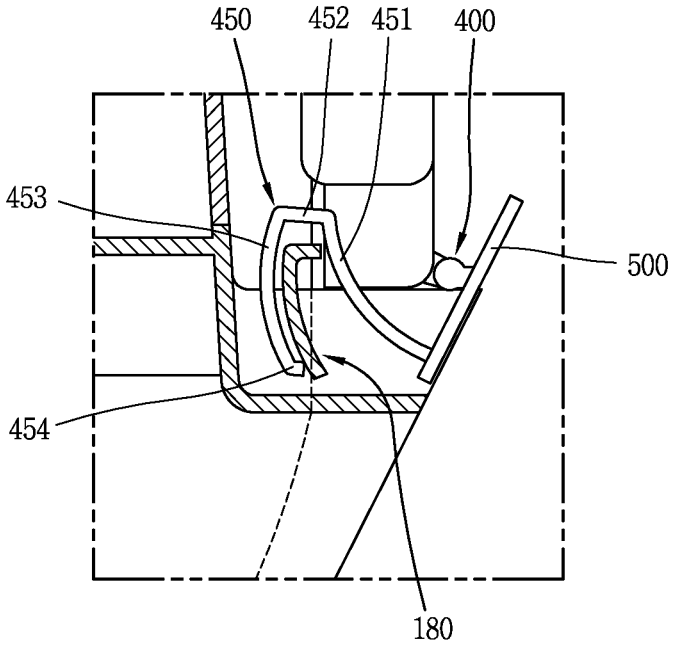
FIG. 11 is a planar view showing the detachable-mounting apparatus of the ice bank of FIG. 2 according to another embodiment.
Figure 12:
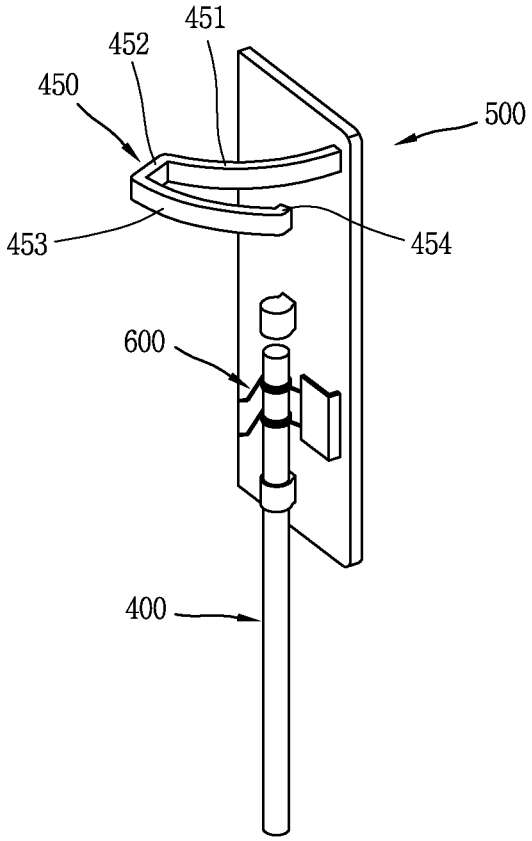
FIG. 12 is a perspective view showing a part of the detachable-mounting apparatus of FIG. 11.

As shown in FIGS. 11 and 12, the detachable-mounting unit includes an elastic hook 450 curvedly-protruding from one side surface (inner surface) of the cover 500 by a predetermined length, and having an elastic force; and a curved-line shaped locking protrusion 180 protruding from one side of the ice bank 100 in the form of a curved-line, and engaged with the elastic hook 450.

The elastic hook 450 includes a first curved-line portion 451 protruding from one side surface (inner surface) of the cover 500 with a predetermined sectional surface and length; a second curved-line portion 452 curvedly-extending from the first curved-line portion 451 by a predetermined length; a third curved-line portion 453 curvedly-extending from the second curved-line portion by a predetermined length; and a locking portion 454 curvedly-extending from the third curved-line portion 453. Preferably, the elastic hook 450 is formed in a cantilevered shape that one end of the first curved-line portion 451 is connected to the cover 500. And, an angle between the first curved-line portion 451 and the second curved-line portion 452 is preferably larger than 90°.

Preferably, the curved-line shaped locking protrusion 180 is formed on the upper surface 163 perpendicular to the one-step concaved surface portion 162 (refer to FIG. 8). Preferably, the curved-line shaped locking protrusion 180 is formed to have a predetermined width and height, and is downwardly protruding from the upper surface 163.

Hereinafter, the operation of the detachable-mounting apparatus of the ice bank for a refrigerator according to a second embodiment will be explained.

Processes for detachably coupling the ice bank 100 to the base member 200 in the second embodiment are the same as those aforementioned in the first embodiment except for components.

Hereinafter, a process for coupling the ice bank 100 to the base member 200 will be explained.

Figure 13:
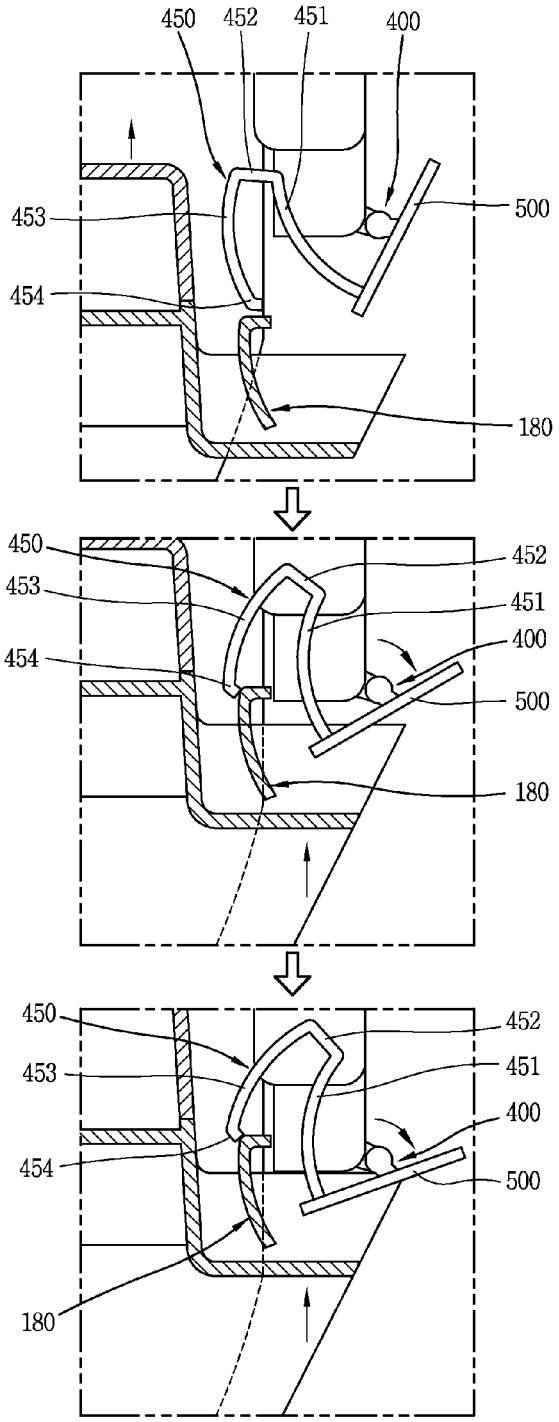
FIG. 13 is a planar view showing an operational state of the detachable-mounting apparatus of FIG. 11.

As shown in FIG. 13, once a user pushes the ice bank 100 into the base member 200, one side of the curved-line shaped locking protrusion 180 provided at the ice bank 100 pushes an outer surface of the locking portion 454 of the elastic hook 450 provided at the cover 500 by contacting thereto. As a result, the elastic hook 450 is rotated centering around the rotation shaft portion 400, and the cover 500 is also rotated centering around the rotation shaft portion 400 by interworking therewith.

Figure 14:
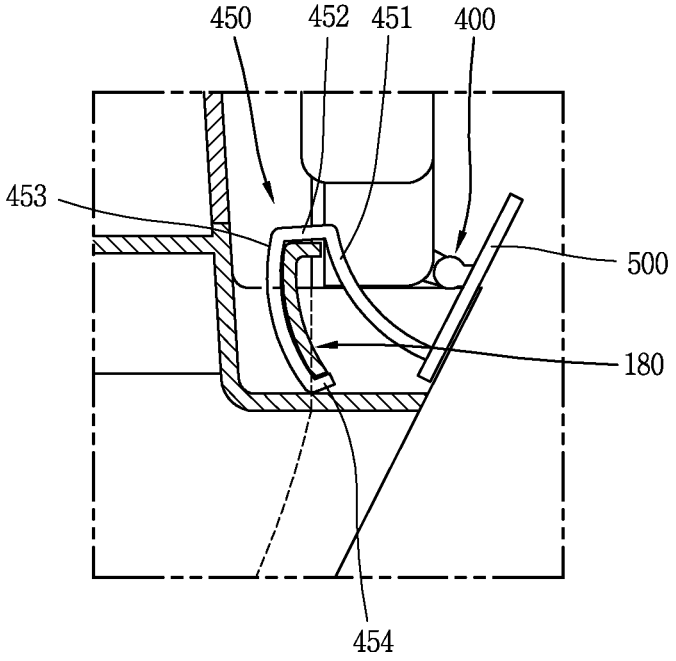
FIG. 14 is a view showing an engaged state of the detachable-mounting apparatus of FIG. 11.

Once the elastic hook 450 is rotated by a predetermined angle, one side of the curved-line shaped locking protrusion 180 is detached from an outer surface of the locking portion 454 of the elastic hook 450. Accordingly, the elastic hook 450 is moved to the original position by an elastic force of the elastic member 600. Here, the elastic hook 450 is moved to the original position with contacting an outer surface of the curved-line shaped locking protrusion 180. And, as shown in FIG. 14, the locking portion 454 of the elastic hook 450 fixes an inner end of the curved-line shaped locking protrusion 180.

As the elastic hook 450 is moved to the original position, the cover 500 is also moved to the original position by interworking therewith.

In order to separate the ice bank 100 from the base member 200, a user pushes the covers 500 provided at both sides of the base member 200 by using two hands, thereby inserting the covers 500 into the recess portions 144 provided at both sides of the ice bank 100. As the covers 500 are pushed, the covers 500 are rotated centering around the rotation shaft portion 400. And, the elastic hook 450 is rotated by interworking with the cover 500, thereby releasing a fixed state of the curved-line shaped locking protrusion 180. At the same time, once the user forwardly pulls the ice bank 100 with holding each one side of the recess portions 144 by using two hands, the ice bank 100 is horizontally moved to be separated from the base member 200.

While the ice bank 100 is horizontally moved, a contacted state of the end of the locking portion 454 of the elastic hook 450 onto an outer circumferential surface of the curved-line shaped locking protrusion 180 is released. And, the cover 500 and the elastic hook 450 are moved to the original positions by an elastic force of the elastic member 600.

In order to couple the ice bank 100 to the base member 200, the ice bank 100 is pushed into the base member 200 as aforementioned.

As above aforementioned, in the ice bank for a refrigerator according to the present invention, the ice bank 100 is horizontally pushed into the base member 200 for coupling, and is horizontally pulled from the base member 200 for separation. This facilitates coupling and detaching processes of the ice bank 100 to/from the base member 200.

Additionally, since the ice bank 100 is horizontally coupled to or separated from the base member 200, ice cubes stored in a storage space of the ice bank 100 are prevented from being dispensed out of the ice bank 100.

Besides, since the ice bank 100 is mounted to or detached from the base member 200 in pushing and pulling manners by the detachable-mounting unit, a detachable-mounting process of the ice bank 100 is facilitated.

Furthermore, since the covers 500 of the base member 200 cover the recess portions 144 of the ice bank 100 into which a user's hands are inserted, an enhanced appearance is implemented.

It will also be apparent to those skilled in the art that various modifications and variations can be made in the present invention without departing from the spirit or scope of the invention. Thus, it is intended that the present invention cover modifications and variations of this invention provided they come within the scope of the appended claims and their equivalents.

The invention claimed is:

1. A refrigerator, comprising:

a refrigerator main body having a cooling chamber;

a door configured to open and close at least a portion of the cooling chamber, the door having a cavity on a rear surface thereof;

an ice maker mounted on the door;

a base member in the cavity of the door, the base member including a vertical base portion and a horizontal base portion;

an ice bank detachably mountable on the base member below the ice maker while horizontally sliding on the horizontal base portion; and a detachable-mounting apparatus configured to detachably mount the ice bank to the base member, wherein the ice bank comprises:

a rear wall having a bottom edge slidably contactable with the horizontal base portion of the base member;

side walls; and a front wall, wherein the detachable-mounting apparatus comprises:

a rotation shaft portion rotatably coupled to the base member in a vertical direction;

a cover that has a plate-like shape, and that has one surface connected with the rotation shaft portion;

an elastic member configured to return the cover to an initial position, the elastic member being a torsion spring; and a detachable-mounting unit configured to detachably mount the ice bank to the base member by interworking with the cover when the ice bank is inserted into or separated from the base member;

wherein the rotation shaft portion and the cover are integrally formed with each other, wherein the rotation shaft portion is provided with an insertion portion for inserting the elastic member, wherein a first end of the elastic member is supported by the cover and a second end of the elastic member is supported by the base member, the first end of the elastic member being opposite of the second end of the elastic member, wherein a recess portion is located at one of the side walls of the ice bank such that the cover is disposed in the recess portion, and wherein the detachable-mounting unit is configured to allow the ice bank to be separated from the base member based on the cover being rotated to an inside of the recess portion.

2. The refrigerator of claim 1, wherein the horizontal base portion of the base member is provided with a horizontal supporting portion configured to support the bottom edge of the ice bank when the bottom edge is horizontally inserted into the base member, the horizontal supporting portion being implemented as a linear guide groove formed on an upper surface of the horizontal base portion, and wherein the bottom edge of the ice bank is provided with a first insertion supporting portion, the first insertion supporting portion supported by being inserted into the horizontal supporting portion.

3. The refrigerator of claim 2, wherein the vertical base portion of the base member is provided with a vertical supporting portion configured to support the ice bank, and wherein the ice bank is provided with a second insertion supporting portion such that the vertical supporting portion of the horizontal base portion is inserted therein.

4. The refrigerator of claim 3, wherein the vertical supporting portion comprises a left supporting portion and a right supporting portion formed on the horizontal base portion of the base member, wherein the left supporting portion has a first protrusion portion protruding from one side of the vertical base portion in a hexahedron shape, and a second protrusion portion extending from an upper surface of the first protruding portion, wherein the right supporting portion has a first protrusion portion protruding from other side of the vertical base portion, and a second protrusion portion protruding from one side of the first protrusion portion of the right supporting portion, and wherein the second insertion supporting portion comprises a stepped protrusion portion relatively protruding with respect to both sides of the ice bank, and one-step concaved surface portions formed at both sides of the stepped protrusion portion such that the left and right supporting portions are inserted therein.

5. The refrigerator of claim 4, wherein the detachable-mounting unit comprises:

a curved-line guide groove penetratingly formed at a lower surface of the base member in the form of a curved-line;

a guide rod curvedly-extending from one side of the rotation shaft portion in the form of a curved-line, and having a locking guide protrusion at one side thereof, the locking guide protrusion protruding so as to be inserted into the curved-line guide groove; and a guide locking portion disposed on a lower surface of the ice bank, and locked by or unlocked from the locking guide protrusion in response to the locking guide protrusion being moved when the ice bank is inserted into or separated from the base member.

6. The refrigerator of claim 5, wherein the guide locking portion comprises an opening groove formed at a lower surface of the one-step concaved surface portion such that the locking guide protrusion is inserted therein, and a locking protrusion formed in the ice bank to be contactable with the inserted locking guide protrusion.

7. The refrigerator of claim 6, wherein the locking guide protrusion is formed such that a sectional surface thereof has a semi-circular shape, and wherein the locking protrusion has a triangular sectional surface such that the locking protrusion comes in contact with the locking guide protrusion to prevent separation of the ice bank.

8. The refrigerator of claim 1, wherein the detachable-mounting unit comprises:

an elastic hook curvedly-protruding from one side surface of the cover, and having an elastic force; and a curved-line shaped locking protrusion protruding from one side of the ice bank in the form of a curved-line, and engaged with the elastic hook.

9. The refrigerator of claim 8, wherein the elastic hook comprises:

a first curved-line portion protruding from one side surface of the cover;

a second curved-line portion curvedly-extending from the first curved-line portion;

a third curved-line portion curvedly-extending from the second curved-line portion by a predetermined length; and a locking portion curvedly-extending from the third curved-line portion.

10. The refrigerator of claim 9, wherein the curved-line shaped locking protrusion is formed in a shape corresponding to the first curved-line portion.

11. The refrigerator of claim 10, wherein the curved-line shaped locking protrusion is configured such that an end portion thereof comes in contact with the locking portion to restrict a motion of the elastic hook.

12. A refrigerator, comprising:

a refrigerator main body having a cooling chamber;

a door configured to open and close at least a portion of the cooling chamber;

an ice maker mounted on the door;

an ice bank detachably mountable below the ice maker; and a detachable-mounting apparatus configured to detachably mount the ice bank to the door, wherein the ice bank comprises:

an ice bank body having an ice-crushing unit and a discharging passage; and a mode conversion apparatus disposed in the ice bank body and configured to guide ice cubes to the ice-crushing unit or to the discharging passage for discharge in a non-crushed state, wherein the mode conversion apparatus comprises:

a guide member rotatably disposed in the ice bank body configured to guide ice cubes to the ice-crushing unit or to the discharging passage for discharge in a non-rushed state;

an elastic member configured to elastically support the guide member;

a driving unit configured to generate a driving force so as to rotate the guide member, the driving unit comprising an actuator mounted to a rear surface of a base member and a hook coupled to a shaft of the actuator; and a curved lever rotatably disposed between the driving unit and the guide member, and configured to rotate the guide member in a manner of changing a linear motion of the driving unit into a rotation motion and transfer rotation force to the guide member, wherein the actuator is configured to push or pull the curved lever, wherein the curved lever comprises:

a coupling shaft portion having a predetermined length and outer diameter, the coupling shaft portion being rotatably coupled to one side of the ice bank body in a horizontal direction;

a first curved shaft portion curvedly-extending from one side of the coupling shaft portion;

a locking shaft portion curvedly-extending from the first curved shaft portion, and connected to the hook of the driving unit;

a second curved shaft portion curvedly-extending from another side of the coupling shaft portion; and a connection shaft portion curvedly-extending from the second curved shaft portion, and connected to the guide member, wherein the locking shaft portion is disposed in an insertion direction of the ice bank wherein the elastic member is a torsion spring, has a first end supported by the guide member and a second end supported by the ice bank body, the first end being opposite of the second end, wherein the hook is configured to detachably insert one end of the locking portion of the curved lever therein, wherein the guide member comprises:

a guide portion for guiding ice cubes;

a rotatable coupling portion formed at one side of the guide portion, and rotatably coupled to the ice bank body; and a locking portion extending from the guide portion and configured to lock a part of the connection shaft portion of the curved lever, wherein the locking shaft portion is disposed in the ice bank body in a mounting direction of the ice bank, wherein the coupling shaft portion rotates based on the locking shaft portion being moved up and down by the actuator, and wherein the guide member rotates to guide ice cubes to the discharging passage in a non-crushed state based on the locking shaft portion being moved upward by the actuator.

13. The refrigerator of claim 12, wherein the connection shaft portion is moved perpendicular to the moving direction of the locking shaft portion.

14. The refrigerator of claim 12, wherein a position limitation portion configured to limit a motion of the guide portion is provided at one side of the guide portion.

15. The refrigerator of claim 12, wherein a body coupling portion configured to moveably couple the guide member is provided at one side of the ice bank body, and wherein the body coupling portion comprises two fixed plate portions protruding from one side of the ice bank body with a gap therebetween;

pin holes penetratingly formed at the fixed plate portions; and a through hole penetratingly formed between the two fixed plate portions, for inserting one side of the guide member.

16. The refrigerator of claim 12, wherein the door is provided with a base member, the base member comprising a vertical base portion and a horizontal base portion, wherein the ice maker is provided at the vertical base portion, and wherein the ice bank is detachably mountable on the base member below the ice maker while horizontally sliding on the horizontal base portion.

17. The refrigerator of claim 16, wherein the driving unit is provided at a rear surface of the vertical base portion of the base member, and wherein the vertical base portion of the base member is provided with a through hole such that an end of the locking shaft portion of the curved lever is inserted therein.

18. The refrigerator of claim 17, wherein the ice bank comprises a transfer unit for transferring ice cubes, an ice crushing unit for crushing ice cubes, and a rotation shaft simultaneously coupled to the transfer unit and ice crushing unit, wherein the base member is provided with a driving motor for driving the rotation shaft, wherein the rotation shaft is provided with a first connection unit, and wherein a shaft of the driving motor is provided with a second connection unit detachably connected to the first connection unit when the ice bank is connected to the base member.

* * * * *